United States Patent [19]

Fujisawa

[11] Patent Number: 4,712,535

[45] Date of Patent: Dec. 15, 1987

[54] METHOD AND APPARATUS FOR SEVERING WAFERS

[75] Inventor: Masayasu Fujisawa, Ninomiya, Japan

[73] Assignee: Hitachi, Ltd., Tokyo, Japan

[21] Appl. No.: 910,142

[22] Filed: Jun. 4, 1986

[30] Foreign Application Priority Data

Jul. 12, 1985 [JP] Japan ..... 60-152524

[51] Int. Cl.[4] ..... B28D 1/04

[52] U.S. Cl. ..... 125/13 R; 82/70.2; 82/46; 51/73 R

[58] Field of Search ..... 125/13 R; 51/73 R; 225/2, 96; 82/20, 70.2, 46

[56] References Cited

U.S. PATENT DOCUMENTS

| | | | |
|---|---|---|---|
| 3,039,235 | 6/1962 | Heinrich | 125/13 R |
| 4,084,354 | 4/1978 | Grandia | 125/13 R |
| 4,227,348 | 10/1980 | Demers | 125/13 R |
| 4,420,909 | 12/1983 | Steere | 125/13 R |
| 4,445,494 | 5/1984 | Schiele | 125/13 R |
| 4,530,452 | 7/1985 | Balyasny | 225/96 |

FOREIGN PATENT DOCUMENTS

| | | | |
|---|---|---|---|
| 2276 | 1/1977 | Japan | 125/13 R |

OTHER PUBLICATIONS

"Improved Slicing and Orientation Technique for I.D. Saving", Industrial Diamond Review, Nov. 1977, pp. 385–387.

*Primary Examiner*—Harold D. Whitehead

*Attorney, Agent, or Firm*—Antonelli, Terry & Wands

[57] ABSTRACT

A method and an apparatus for severing a workpiece into wafer slices, wherein the inclined surface to be cut can be processed to remove protrusions or impressions which occur around the cut surface. The workpiece has a front end portion which is cut by a cutting tool and a rear end portion which is inclined with respect to the central position of the surface of the workpiece to be cut. This central position is the center of rotation about which the workpiece is rotated to generate a cone shape. When the workpiece is fed axially for cutting to obtain wafers, the central position of the workpiece surface to be cut is held at a constant position so that the workpiece can be cut continuously at a constant angle of inclination. The front end portion of the wafer being cut is rotated while being pulled in a direction from the workpiece until the completion of the severing operation. Then, when the severing has been completed, the process wafer is rotated and pressed toward the workpiece so that protrusions, impressions or grooves can be removed from around the central portion of the cut end portion.

7 Claims, 4 Drawing Figures

METHOD AND APPARATUS FOR SEVERING WAFERS

BACKGROUND OF THE INVENTION

The present invention relates to a method and apparatus for severing bar-shaped workpieces, such as ingots made of silicon, ferrite or the like, by cutting tools with a high degree of accuracy while the workpieces are rotated.

Conventionally, it is known to feed a rotatably fed bar-shaped workpiece by means of a grinding disk, wherein a ring-shaped grinding disk is defined along the inner periphery of a doughnut-shaped blade to make the outer periphery of the bar-shaped workpiece contact the inner periphery of this grinding disk. The workpiece is fed rotationally, while the grinding disk is rotated for severing wafers from the workpiece. This method is useful for reducing the curvature of the severed surface and improving the cutting efficiency. As shown in a paper titled Improved Slicing and Orientation Technique for I.D. Sawing, Industrial Diamond Review, issued Nov. 1977, pp. 385 to 387, since it is necessary to position the central axis of the grinding disk parallel to the rotational axis of the workpiece and to align the rotational center of the workpiece with the axis of the workpiece, the workpiece cannot be severed in such a way that the axis of the workpiece may be inclined relative to the axis of the grinding disk. Furthermore, since the cut end portion of the workpiece is not supported during the severing process, the unprocessed portion toward the rotational center portion which connects the main portion of the workpiece with the cut end portion is likely to be broken just before the completion of severing due to the action of the gravitational force or the like and causes defects on the processed portion in the form of protrusions or recesses. While the conventional method of severing the rotating workpiece by means of a grinding disk has advantages, it is not free from the above-discussed disadvantage. This makes it impossible to apply the method to an ingot of silicon or the like which must be severed by the grinding disk by inclining the ingot at an angle of 0° to 7°, so as to be free from protrusions or recess around the central cut portion.

SUMMARY OF THE INVENTION

An object of the present invention is to provide a method and device for severing a rotatably fed workpiece in which an inclined surface is to be cut while eliminating protrusions or indentations generated around the central portion of the cut surface.

To achieve this object, the rear end portion of the workpiece is inclined, taking the central position of the surface to be cut by the cutting tool as a center, while the workpiece is rotated about an axis inclined to the axis of rotation of the cutting tool, taking as the rotational center the central position of the surface to be cut. When the workpiece is fed axially for the severing process, the central position of the surface to be cut of the end portion of the workpiece may be constantly retained at a predetermined position and continuously cut at a constant angle of inclination. Furthermore, after the cut portion of the workpiece has been pulled in the opposite direction thereof until the work has been cut, the cut portion of the workpiece is pressed for rotation toward the direction in which the work is fed to prevent protrusions or indentations or grooves from being generated around the central portion at the end of the workpiece.

DESCRIPTION OF PRESENTLY PREFERRED EMBODIMENTS

Figure 1:
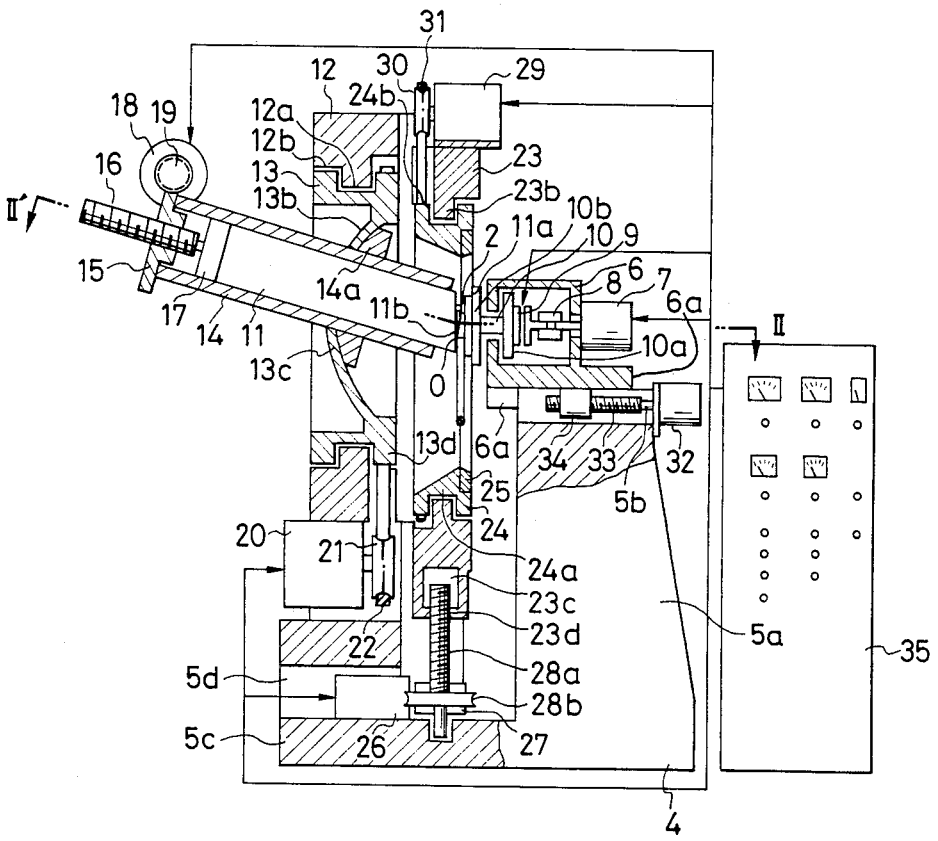
FIG. 1 shows a cross-sectional front elevational view, illustrating an embodiment of the device for severing a rotating workpiece according to the present invention.
Figure 2:
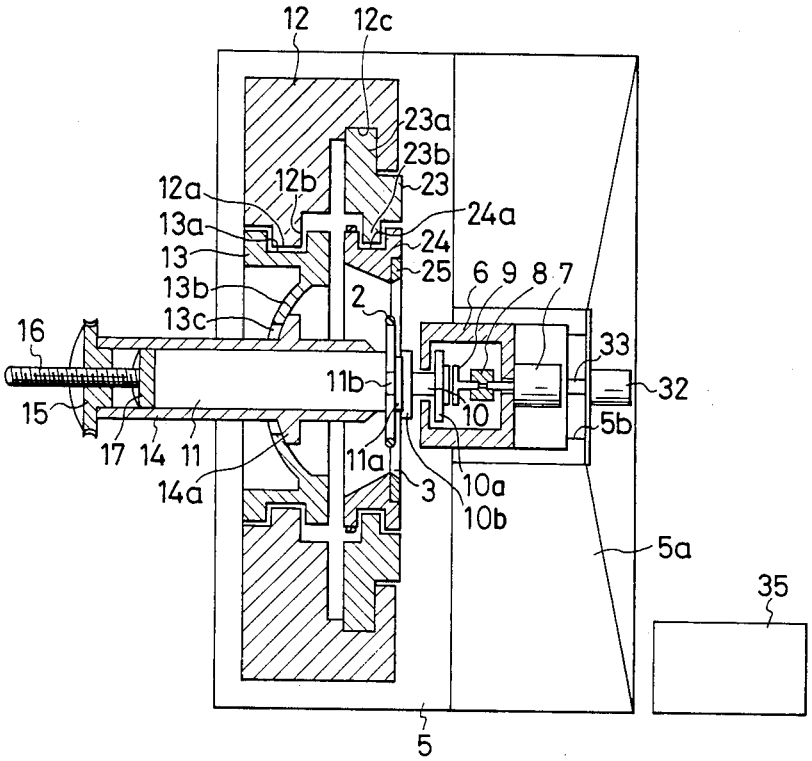
FIG. 2 shows a cross-sectional front elevational view taken along the line II—II of FIG. 1.

In FIGS. 1 and 2, reference numeral 4 designates a base wherein, on the upper surface of one protruding portion 5*a*, a dovetail groove 5*b* is provided for guiding a platform 6 to be described later for supporting the workpiece when it is slidably moved, while a horizontal bore 5*d* is provided in another protruding portion 5*c*. The platform 6 has on its lower end surface a protruding portion 6*a* which is slidable along the groove 5*b*. A motor 7 is provided on an upper portion of the platform 6 for rotating the cut wafer. An electromagnetic chuck 9 is connected via a coupling 8 to the shaft end portion of the motor 7. A vacuum chuck 10 is connected with the electromagnetic chuck 9 at end surface 10*a* and has an H-shaped cross section to receive at the other and surface 10*b* a wafer 11*a* obtained by cutting the end of the ingot 11 at the other end surface. The motor 7 and the chucks 9, 10 are supported by an air bearing 6*a*. The ingot workpiece 11 is made of silicon, GGG, ferrite or the like. The motor 7 for rotating the wafer 11*a* is driven for a predetermined time period from immediately prior to completion of cutting to a predetermined time after the severing process has been completed. The motor 7 rotates the wafer 11*a* received in the vacuum chuck 10 at the same circumferential speed as that of ingot 11 via the coupling 8 and the electromagnetic chuck 9. If the motor 7, coupling 8, the electromagnetic chuck 9 and the vacuum chuck 10 were not provided an unprocessed portion is left at the central portion of the cut surface of the wafer 11*a*. As a result the unprocessed portion would break due to gravitational force or rotational force and separate itself from the ingot 11, thereby stopping the rotation. As the result, deflection of the side surface of the grinding disk 2 (about 5 to 10 μm) would cause local grooves in the cut surface of the wafer 11*a*. Thus, according to the present invention, the motor 7 is driven immediately before the completion of cutting of wafer 11*a* until after completion of cutting to make the entire cut surface of the wafer 11*a* uniformly contact the grinding disk 2 and prevent grooves from being formed on the cut surface of the wafer 11*a*. Reference numeral 12 designates a casing, which is fixedly supported on the base 5 and within which a guide 13 to be described later is rotatably supported by air bearing 12*a*, while the guide 13 is supported by a thrust air bearing 12*b* so as not to move in the horizontal direction. On the outer peripheral surface of the guide 13 a groove 13*a* is rotatably supported in the casing 12 via the air bearing 12*a* and the thrust air bearing 12*b*, and on a portion of the inner periphery of the guide 13 a portion 13*b* has a through hole 13*c* at a fixed semispherical central portion thereof. The geometric center of the semispherical central portion of the guide 13 intersects a plane along which grinding disk 2 moves up and down and lies along a line of rotation of the guide 13, i.e., a central point of the wafer 11*a* to be cut from the end portion of the ingot 11. Reference numeral 14 designates an ingot holder. The ingot 11 is movably inserted in the ingot holder interior along the ingot's longitudinal direction (i.e. in the direction of the central axis). One end of the outer periphery of the holder 14 corresponds to the guide portion 13*b* and has a flange 14*a* fastened by a bolt or the like (not shown in the drawing). Consequently, the central position of the cut surface of wafer 11*a* at the end of ingot can be held constant at the central point "0", even if the ingot 11 is fed by a predetermined amount in the longitudinal direction along the surface of the inner periphery of the ingot holder 14 as the wafer is severed. The central position can also be held constant even if the flange 14*a* of the ingot holder 14 is moved along the semispherical guide portion 13*b* of the guide 13 to alter the angle of inclination of the ingot 11, and even if the guide 13 and the ingot holder 14 are rotated by the motor 20 hereinafter described for rotating the ingot 11. Reference numeral 15 designates a worm wheel for feeding the ingot 11 of the ingot holder 14 and supports a threaded shaft 16 at its central portion. This threaded shaft 16 is fixed to a flange 17 which is movable along the inner periphery of the holder 14 and contacts the rear end surface of the ingot 11. Reference numeral 18 designates a motor for feeding the ingot 11 which is supported on a platform (not shown) which is fixed to the holder 14. The motor 18 has a worm 19 fixed thereon to engage the worm wheel 15 for feeding the ingot 11. Consequently, when the motor 18 is driven, the threaded shaft 16 is moved axially via the worm 19, and the worm wheel 15 and the ingot 11 is fed by a predetermined amount of axial movement of the flange 17. A motor 20 for rotating the ingot 11 is fixedly supported by the casing 12 and fixedly supports a pulley 21 at the end portion of the motor shaft. This pulley 21 is connected via a belt 22 to a pulley 13*d* which is defined at the outer peripheral surface of the guide 13. Consequently, when the motor 20 is driven, the ingot 11 is rotated such that its rear end portion rotates radially (conically or to generate a cone) with its central point "0" as the cone apex. The rear end portion is rotated together with the guide 13 and the ingot holder 14 via the two pulleys 21 and 13*d* and the belt 22, while the central position of the surface of wafer 11*a* to be cut is held at the central point "0". A stator 23 has a cross-sectional profile which is angularly defined, as shown in FIG. 2, and an inner periphery which is circular as viewed perpendicular to the plane of FIGS. 1 and 2. On the two angular surfaces of the stator 23 opposed to each other are two outwardly protruding portions 23*a* which are vertically slidably along two vertical grooves 12*c* in the casing 12. On the central portion of the circular inner periphery of the stator 23 as taken in the longitudinal direction, a ring-shaped inward protrusion 23*b* is defined. On the lower end portion of the stator 23, there is provided an angular space 23*c* disposed laterally of the longitudinal direction of the stator and having a threaded bore 23*d* which communicates space 23*c* with the lower end outer surface of the stator 23. A rotor 24 has an apertured cylindrical shape and a groove 24*a* on the central portion of its outer peripheral surface for receiving the protruding portion 23*b* of the stator 23. A ring-shaped blade holder 25 is fastened on an end surface of the inner periphery of the rotor 24 for interleaving a blade 1 to which is fixed the doughnut-shaped grinding disk 2. Reference numeral 26 designates a motor for feeding the grinding disk 2 and is fixedly supported within the through aperture 5*d* of the base 4, connecting a worm shaft 27 at the end thereof. This worm shaft 27 engages a worm wheel 28*b* which is supported by the threaded shaft 28*a* engaging the threaded hold 23*d* of the stator 23. Consequently, when the motor for feeding the grinding disk is driven, the threaded shaft 28*a* is rotated via the worm shaft 27 and the worm wheel 28*b*, and the grinding disk 2 is moved vertically via the mating threaded hold 23*d* together with the stator 23 and the rotor 24. Reference numeral 29 designates a motor for rotating the grinding disk and is fixedly supported on the external surface of the stator 23. The motor 29 fixedly supporting a pulley 30 at the end portion thereof. This pulley 30 is connected via a belt 31 to a pulley 24*b* which is defined at the one portion of the surface of the outer periphery of the rotor 24. Consequently, when the motor 29 for rotating the grinding disk is driven, the grinding disk 3 is rotated about the central point "0" as its axis together with the rotor 24, two pulleys 24*b* and 30 and the belt 31. Reference numeral 32 designates a motor for pulling the wafer which is fixedly supported on the upper surface of one protruding portion 5*a* of the base 5, connecting a threaded shaft 33 at the end of the shaft. This shaft 33 is engageably supported by a nut 34 which is fixedly supported on the bottom surface of the platform 6. The motor 32 is driven from immediately before the completion of cutting to completion of cutting to pull, via the nut 34 and the platform 6, the wafer 11*a* horizontally in the direction opposite the ingot 11. The grinding disk 2 cuts the remaining portion 11*b* of the center of the wafer 11*a*. After the completion of cutting, the motor 32 is driven in the opposite direction to move the wafer 11*a* to the side of the ingot 11 to insert it within the wafer encasing case (not shown) which is disposed below the vacuum chuck 10. The reason why the wafer 11*a* is moved to the side of ingot 11 after the completion of cutting is that, if the wafer 11*a* remains to be pulled also after the completion of cutting, since the remaining portion 11*b* of the center of wafer 11*b* is broken to be left as the protrusion, the protrusion is eliminated by the grinding disk 2 by moving the wafer 11*a* to the side of ingot 11 after the completion of cutting and by pressing it to the side surface of the grinding disk 2. Reference numeral 35 designates a control unit which controls the drive of motors 7, 18, 20, 26, 29 and 32.

Figure 3:
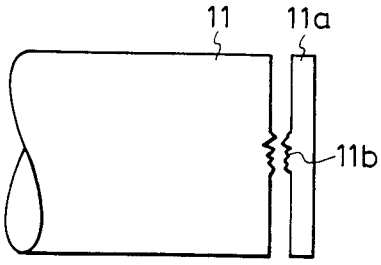
FIG. 3 shows a view of the cut workpiece with a protrusion disposed around the central portion of the cut surface when shearing stress has been applied.
Figure 4:
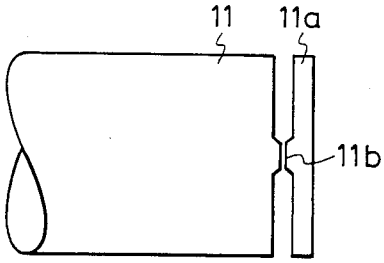
FIG. 4 shows a view of the cut workpiece with the protrusion disposed around the cut surface when tensile stress or bending stress has been applied.

Next, the operation of the invention is described. First, the end surface of ingot 11 is not inclined at a predetermined angle. When a mounting jig (not shown in the drawing), which has a surface adjustable at any angle is mounted on the other end surface 10*b* of the vacuum chuck, the worm wheel 15 for feeding the ingot and the flange 17 are removed to insert the ingot into the interior passing through the rear end portion of the ingot holder 14, and the end surface of the ingot is held to the jig. Subsequently, after the worm wheel 15 for feeding the ingot and the flange 17 are again mounted respectively to the predetermined position at the rear end portion of the holder 14, the holder 14 is caused to slide along the inner periphery of the guide portion 13*b* to incline the ingot 11 at a predetermined angle with the central point "0" as its axis. Then, the motor 20 for rotating the ingot is driven in accordance with the instruction from the control unit 35 and the guide 13 is rotated via two pulleys 21 and 13*d* and the belt 22, the ingot 11 is rotated to generate a cone with the central point "0" at its end being the axis of rotation. Furthermore, motor 29 for rotating the grinding disk is rotated in accordance with the instruction from the control unit 35 to rotate the rotor 24 and the grinding disk 2. Further, when the motor 26 for feeding the grinding disk is driven in accordance with the instruction from the control unit 35 and a threaded screw 28 is rotated via the worm shaft 27 and the worm wheel 28, the stator 23 feeds the rotor 24 and the grinding disk 2 radially (in the vertical direction with respect to FIG. 1), so that the grinding disk 2 starts to sever the ingot 11. Consequently, the end portion of the ingot severed by the grinding disk 2 is not generally used as the work (wafer), the severing work of the ingot by the grinding disk 2 is completed at this point. Subsequently, when the severing work of the ingot by the grinding disk 2 is completed, the motor 20 for rotating the ingot and the motor 29 for rotating the grinding disk are stopped in accordance with the instruction of the control unit 35 and only the motor 26 for feeding the grinding disk is rotated in the opposite direction to return the grinding disk to its original position. Thereafter, when the jig and the cut end portion of ingot are released from the outer end surface 10*b* of the vacuum chuck 10, the motor 18 for feeding the ingot is driven in accordance with the instruction from the control unit 35 to move the threaded shaft 16 via the worm 9 and the worm wheel 15 in the direction of the inner shaft to attach the end surface of the ingot 11*a* to the outer end surface of the vacuum chuck 10. The motor 18 for feeding the ingot is then stopped in accordance with the instruction from the control unit 35, while the motor 20 for rotating the ingot, the motor 29 for rotating the grinding disk 2 and the motor 26 for feeding the grinding disk are again driven, with the end point of ingot 11*a* starting to be cut by the grinding disk 2. Then, when, immediately before the completion of cutting, the shape of remaining portion 11*b* between the end of ingot 11 and the wafer which is being processed becomes smaller, the motor 32 for pulling the wafer is driven in accordance with the instruction from the control unit 35, and the wafer 11*a* is pulled in the direction away from the ingot 11 and the remaining portion 11*b* of the wafer center 11*a* is broken. Simultaneously, the motor 7 for rotating the wafer is driven in accordance with an instruction from the control unit 35 to rotate the wafer 11*a* by means of the vacuum chuck 10, while the motor 32 for pulling the wafer is driven in the opposite direction to move the wafer 11*a* toward the side of the ingot 11. The rotating wafer 11*a* is then pressed against the side surface of grinding disk 2, and its broken portion 11*b* is polished by the grinding disk 2. Consequently, the cut surface of the wafer 11*a* can be cut flatly. In other words, if the surface 11*a* is rotated only at the same circumferential speed as that of the ingot 11, the remaining portion 11*b* of the cut surface of the wafer 11*a* undergoes a sheering stress caused by the distortion or the like due to the minor difference of the circumferential speed between the ingot 11 and the wafer 11*a*. As a result, it is cut along the convex and concave portion, as shown in FIG. 3, which is likely to cause the remaining impressions after the removal of the remaining portions. In contrast, if the wafer 11*a* is pulled by rotating it, depending on the rotation of ingot 11, the end portion of remaining portion 11*b* of the cut surface of wafer 11*a* is cut flatly, as shown in FIG. 4. And yet, according to the present invention, since, when the cut surface of wafer 11*a* is cut from the ingot, the rotating wafer 11*a* is moved to the side of the ingot 11 to be pressed to the side surface of grinding disk 2, the remaining portion 11*b* of center of the cut surface of the wafer 11*a* is polished by the grinding disk 2 and the surface of wafer can be formed flatly. When, in this way, the cutting of wafer is completed, the wafer 11*a* is removed from the vacuum chuck 10 for containment in the lower wafer encasing box. The above is one cutting cycle of wafer 11*a*. By repeating the above operation, additional wafers 11*a* can be cut sequentially from the into 11.

Consequently, according to the rotating work cutting device of the present invention, the creation of protrusions, impressions or grooves can be prevented on the cut surface of wafer 11*a* to achieve a flat wafer cut.

By the way, in the above described embodiment, the grinding disk is provided along the inner periphery of the device. The present invention is not restricted to that particular embodiment and can be applied also to the case wherein the grinding disk is provided along the outer periphery of the device. Further, the motor for rotating the wafer can be rotated in an accurate synchronized relation with the motor for rotating the ingot, to rotate the wafer constantly and the use of electromagnetic chuck is rendered unnecessary. Further, the control unit can control the drive and the stoppage of each motor by using, for example, a limit switch.

According to the results of an experiment made by the inventor, the use of the cutting device according to the invention gives a warpage of the cut surface within 10 $\mu m/\phi$ 150 mm, while the prior devices give 25 $\mu m/\phi$ 150 mm. Since the grinding disk need only be fed by a half of the diameter of the ingot to cut the ingot, an ingot having twice the diameter can be cut in the same time as compared with prior ones of single diameter. Furthermore, a silicon ingot having $\phi$ 200 which previously could not be cut by the prior grinding disk having a 27 inch outer diameter can now be cut.

As described above, according to the present invention, the wafer can be cut flat in a short period of time as well as a high accuracy without protrusions, impressions or grooves being produced on the cut surface and with reduced warpage. Furthermore, since the surface can be cut at any angle of inclination, and the silicon ingot having $\phi$ 200 can be cut, the extent of application of the device can be expanded.

What is claimed is:

1. A method of severing an end portion of an ingot into wafers and the like by means of a cutting tool, comprising the steps of holding a front end portion of the ingot, cutting the end portion of the ingot until a portion remains between a cut end surface from which a wafer is formed and the remainder of the ingot, controlling the stress applied to a remaining portion between the cut end surface of the ingot from which a wafer is formed and the remainder of the ingot just before severing the cut end surface so as to pull the wafer at a right angle relative to the plane of the cut end surface, severing the remaining portion between the ingot and the cut end surface to form the wafer, moving the cut surface of the separated wafer toward the remainder of the ingot while rotating the wafer, and pressing the wafer against the cutting tool to remove any undesired remaining material caused by the severing operation.

2. A method of severing an end portion of an ingot into wafers and the like by means of a cutting tool, comprising the steps of holding the ingot at a predetermined angle of inclination to an axis perpendicular to a plane along which severing takes place, reciprocating the cutting tool along the severing plane, rotating the ingot about the axis from a central point at around the severing plane to generate a conical surface whose apex is at the central point, holding a front end portion of the ingot which is to be severed into a wafer, and severing the rotating ingot at the predetermined angle of inclination by means of the cutting tool.

3. A method of severing an end portion of an ingot into wafers and the like, comprising the steps of holding the ingot at a predetermined angle of inclination to an axis perpendicular to a plane along which severing takes place, reciprocating the cutting tool along the severing plane, rotating the ingot about the axis from a central point at around the severing plane to generate a conical surface, holding a front end portion of the ingot to be severed into a wafer, severing with the cutting tool the rotating ingot at the predetermined angle of inclination until a portion remains between the ingot and the front end portion, controlling the stress applied to the remaining portion so as to pull the wafer away from the ingot in a direction perpendicular to the severing plane, severing the remaining portion while the front end portion is rotated, and pressing the wafer toward the ingot and against the cutting tool to remove any undesired material remaining on the wafer caused by the severing operation.

4. A method of severing according to claim 1 or claim 2, wherein the cutting tool rotatingly reciprocates in the same plane.

5. An apparatus for severing ingots into wafers and the like, comprising means for rotating an ingot, means for feeding the ingot in an axial direction, cutting tool means, means for rotating the cutting tool means about an axis parallel the rotational axis of the ingot rotating means, means for feeding the ingot and the cutting tool means, wherein the ingot feeding means has an axis perpendicular to a rotational axis of the cutting tool rotating means, means for supporting a front end portion of the ingot such that the ingot is inclined with respect to the rotational axis of the ingot rotating means, means for rotating the supporting means about a central point of a cut surface of the ingot, and means for axially moving the front end portion away from and toward the ingot which is rotated and cut at an angle of inclination to its own axis.

6. An apparatus according to claim 5, wherein means is provided for controlling stress applied to an uncut portion remaining between the ingot and the front end portion by pulling the front end portion at an angle relative to the plane of the cut surface.

7. An apparatus according to claim 6, wherein means is provided for pressing the front end portion, after separation from the ingot, toward the ingot and against the cutting tool means while rotating the front end portion.

* * * * *